US009770085B2

(12) United States Patent
Pepic

(10) Patent No.: US 9,770,085 B2
(45) Date of Patent: Sep. 26, 2017

(54) BACKPACK WITH ELECTRONIC DEVICE STORAGE AND UMBRELLA COMPARTMENT

(71) Applicant: Seid Pepic, Bronx, NY (US)

(72) Inventor: Seid Pepic, Bronx, NY (US)

( * ) Notice: Subject to any disclaimer, the term of this patent is extended or adjusted under 35 U.S.C. 154(b) by 0 days.

(21) Appl. No.: 15/169,316

(22) Filed: May 31, 2016

(65) Prior Publication Data

US 2016/0345713 A1 Dec. 1, 2016

Related U.S. Application Data

(60) Provisional application No. 62/169,096, filed on Jun. 1, 2015.

(51) Int. Cl.

| | |
|---|---|
| ***B60R 7/12*** | (2006.01) |
| ***A45F 3/04*** | (2006.01) |
| ***A45C 13/40*** | (2006.01) |
| *A45F 3/00* | (2006.01) |

(52) U.S. Cl.

CPC ..... *A45F 3/04* (2013.01); *A45C 13/40* (2013.01); *A45F 2003/003* (2013.01); *A45F 2003/045* (2013.01)

(58) Field of Classification Search

CPC ..... B60R 7/12; A45F 2003/003; A45F 5/00
USPC ..... 224/625, 627, 628, 643, 652, 653, 658, 224/915

See application file for complete search history.

(56) References Cited

U.S. PATENT DOCUMENTS 4,537,339 A * 8/1985 Pearson ..... A45B 11/02 224/186
5,263,837 A * 11/1993 Dompe ..... A45B 11/02 224/190
5,409,291 A * 4/1995 Lamb ..... A01K 97/10 224/155
5,620,034 A * 4/1997 Flis ..... A63B 55/406 150/159
5,704,530 A * 1/1998 Scherer ..... A45F 3/08 224/632
5,887,771 A * 3/1999 Perry ..... A45B 11/02 224/190
6,024,264 A * 2/2000 Java ..... A45B 3/00 135/16
6,053,385 A * 4/2000 Ward ..... A45B 11/00 224/153
6,308,722 B1 * 10/2001 Christie ..... A45B 11/00 135/16
6,866,173 B2 3/2005 Haber
6,889,883 B2 5/2005 Nykoluk
7,069,939 B1 * 7/2006 Conde ..... A45B 25/00 135/16

(Continued)

FOREIGN PATENT DOCUMENTS

| | | |
|---|---|---|
| CN | 201388688 Y | 1/2010 |
| CN | 201727036 U | 2/2011 |
| CN | 201879024 U | 6/2011 |

*Primary Examiner* — Brian D Nash
(74) *Attorney, Agent, or Firm* — Pollack, P.C.

(57) ABSTRACT

A backpack and an umbrella, in combination, the backpack having a large main compartment that provides a large, padded pocket with a hook-and-loop closure, wherein a mobile electronic device may be securely stored with a snug fit. One or more apertures for earphones are provided, which enable(s) audio files to be accessed and played from a mobile electronic device while it is stored in the pocket and the backpack is being worn. The backpack further provides a long, slender umbrella compartment, and a deep socket which supports the user's umbrella when the umbrella is opened.

14 Claims, 2 Drawing Sheets

(56) References Cited

U.S. PATENT DOCUMENTS

| | | | | |
|---|---|---|---|---|
| 7,959,048 | B1 * | 6/2011 | Cyr | A45C 5/06 224/651 |
| 8,556,141 | B1 | 10/2013 | Ferraiolo | |
| 8,678,019 | B2 * | 3/2014 | Christie | A45F 4/02 135/16 |
| 8,733,378 | B2 * | 5/2014 | Tayebi | A45B 11/02 135/16 |
| 8,944,300 | B1 * | 2/2015 | Kaufman | A45B 11/02 135/16 |
| 2004/0232186 | A1 * | 11/2004 | Huang | A45B 11/00 224/576 |
| 2007/0175941 | A1 * | 8/2007 | Berry | A45C 7/0077 224/583 |
| 2007/0262103 | A1 * | 11/2007 | Blakley | A45B 11/02 224/190 |
| 2009/0194570 | A1 * | 8/2009 | Vadher | A45B 11/02 224/576 |
| 2011/0147427 | A1 * | 6/2011 | Weaver | A45B 11/00 224/576 |
| 2011/0186611 | A1 * | 8/2011 | Eberle | A45F 3/04 224/583 |
| 2013/0048693 | A1 * | 2/2013 | Chin | A45B 25/26 224/600 |
| 2013/0056510 | A1 * | 3/2013 | Yun | A45F 5/02 224/575 |
| 2013/0092715 | A1 * | 4/2013 | Tayebi | A45B 11/02 224/576 |
| 2013/0233362 | A1 * | 9/2013 | Miller-Klerer | A45B 23/00 135/16 |
| 2013/0313295 | A1 * | 11/2013 | Jacquette | A45B 11/02 224/190 |

* cited by examiner

BACKPACK WITH ELECTRONIC DEVICE STORAGE AND UMBRELLA COMPARTMENT

CROSS-REFERENCE TO RELATED APPLICATION

This application is based on and claims the benefit of U.S. Provisional Patent Application Serial No. 62/169,096, filed Jun. 1, 2015, the disclosure of which is hereby incorporated by reference herein in its entirety.

FIELD OF THE DISCLOSURE

This disclosure relates generally to portable storage arrangements and, more particularly, to a backpack for storage of articles and the like.

BACKGROUND OF THE DISCLOSURE

Backpacks have become an essential item of equipment on high school and college campuses. Even some corporate executives have recognized their benefits and started using them. Unfortunately, traditional backpacks pose some inconveniences, for example, they have often been found difficult to use while wearing a raincoat. Hence, various attempts have been made to associate or incorporate protection of the user from rain and other elements into backpacks. Also, while certain contemporary briefcases and bags have been designed specifically for use with a laptop, a tablet, or other mobile electronic device, such features have not been utilized in backpacks.

A variety of backpacks and other accessories have been developed in attempt to address one or more of these problems. In one conventional arrangement, a backpack is provided with an integral umbrella for protecting a user from the elements without the user having to hold the umbrella during use, thus leaving both of the user's hands free for other tasks. A smaller, vertical compartment within the backpack houses the umbrella, which is developed by an actuator mechanism on a shoulder strap portion of the backpack. When deployed, the umbrella extends upwardly over the top of the user via a sectionalized shaft. In this manner, the user is protected from rain and other elements while walking and wearing the backpack, leaving both hands free.

Another arrangement provides a backpack assembly for carrying an umbrella and/or child hands free. The assembly includes a back portion and a front portion. The front portion has a strap member with umbrella supports for holding an umbrella in an opened or closed position in front of the wearer to protect him/her from the elements. Optionally, a child carrier may also be attached to the front portion.

Further traditional devices provide a backpack or bag having a closure such that the bag may be substantially closed to the outside environment. The closure comprises a CD port attached to the bag, the CD port having a bottom portion with two raised portions, each defining opposing inner sides, and the bottom portion further defining a cutout portion. The CD port further comprises a resilient top portion defining two opposed outer sides having a shape that generally conforms to a shape of the opposed inner sides of the raised portion.

Still other conventional backpack arrangements have been provided that structurally comprise an umbrella within the backpack or vice versa. For instance, an opening is formed at the upper part of the backpack and the umbrella is propped open from the opening. Alternatively, the umbrella comprises a backpack bag main body. A bag is arranged at the outer side of the umbrella which is secured inside the bag, and the umbrella is opened by pressing a switch which controls the umbrella. The umbrella can be folded into the bag when not in use. By yet another configuration, a built-in umbrella-inserting backpack with a rear bag is provided. A fastening buckle is arranged in the rear bag and can be used to secure a normally-used folding backpack, with the aim of providing convenience in shedding rain without grabbing an umbrella can be placed in the rear bag.

While traditional arrangements generally provide an integral umbrella within a backpack, they do not protect the user from lateral movement of the umbrella due to wind shear. In many regions of North America, Europe, Southeast Asia and the Far East, harsh winds can cause lateral movement of the umbrella when it is in the extended position. This can not only damage the backpack and its contents, but also compromise protection afforded by the umbrella from rain and other elements.

SUMMARY OF THE DISCLOSURE

It is, therefore, an object of the disclosure to combine secure storage for a mobile electronic device and an umbrella compartment in a backpack unit.

Another object of the disclosure is to provide a backpack with electronic device storage and an umbrella compartment that avoids damage to the backpack and its contents during use such as due to wind shear and associated lateral movement of the umbrella when in the extended position.

A further object of the disclosure is to provide a backpack with electronic device storage and an umbrella compartment that does not compromise the protection from rain and other elements as afforded by the umbrella.

Still another object of the disclosure is to provide a backpack with electronic device storage and an umbrella compartment that protects the user from wind shear due to harsh winds and associated lateral movement of the umbrella when in the extended position.

Yet another object of the disclosure is provide a backpack that not only includes secure storage for a mobile electronic device, but also has an umbrella compartment which is fully supported by the backpack when the backpack is worn and the umbrella is opened.

Still a further object of the disclosure is to provide a backpack with electronic device storage and an umbrella compartment, which provides secure storage for a mobile electronic device as well as an aperture for earphones.

Yet a further object of the disclosure is to provide a backpack designed specifically for use with a laptop, a tablet, or other mobile electronic device, that also provides for use of a waterproof canopy.

It is another object of the disclosure to provide a retractable umbrella canopy and secure, waterproof storage for a mobile electronic device within a backpack, while enabling the user to wear earphones connected to the stored mobile electronic device.

It is a further object of the disclosure to provide a backpack with electronic device storage and an umbrella compartment sized and configured to removably fit substantially within the umbrella compartment when the umbrella is in a closed position.

Still another object of the disclosure is to provide a backpack with electronic device storage and an umbrella compartment that overcomes the disadvantages of conventional arrangements.

According to one aspect of the disclosure, there is provided a backpack with electronic device storage and an umbrella compartment. The backpack provides a large, padded pocket with a hook-and-loop closure, wherein a mobile electronic device may be securely stored with a snug fit. One or more apertures for earphones are provided, which enable(s) audio files to be accessed and played from a mobile electronic device while it is stored in the pocket and the backpack is being worn. The backpack further provides a long, slender umbrella compartment, and a deep socket which supports the user's umbrella when the umbrella is opened.

In accordance with another aspect of the disclosure, there is provided a backpack and an umbrella, in combination, the backpack having a large main compartment, at least one shoulder strap, a hip belt, and one or more side pockets. The main compartment has a main compartment fastener such that the main compartment may be opened or secured closed, the main compartment containing a main pocket. The backpack also has an umbrella compartment, the umbrella being sized and configured to removably fit substantially within the umbrella compartment when the umbrella is in a closed position. The umbrella compartment contains a socket including a clamp at a bottom thereof, the clamp being configured to secure the handle of the umbrella, and the umbrella compartment and socket being configured to hold the umbrella in an axial position relative to the longitudinal axis of the backpack when the handle is secured by the clamp, wherein the umbrella compartment is affixed to one of the shoulder straps. In addition, the umbrella compartment includes a flap, the flap being configured to cover the top of the umbrella compartment, and the flap including a flap fastener such that the flap may be opened or secured shut.

According to a further aspect of the disclosure, there is provided a backpack and an umbrella, in combination, the backpack having a large main compartment, at least one shoulder strap, a hip belt, and one or more side pockets. The main compartment having a main compartment fastener such that the main compartment may be opened or secured closed, the main compartment containing a main pocket. The backpack also has an umbrella compartment, the umbrella being sized and configured to removably fit substantially within the umbrella compartment when the umbrella is in a closed position. The umbrella compartment contains a socket including a clamp at a bottom thereof, the clamp being configured to secure the handle of the umbrella, and the umbrella compartment and socket being configured to hold the umbrella in an axial position relative to the longitudinal axis of the backpack when the handle is secured by the clamp. The backpack further comprises a rigid frame, the rigid frame having two vertical members at each side of the backpack and two cross members at a top and bottom of the backpack, wherein the umbrella compartment is braced against the frame with diagonal members, such that each diagonal member forms triangles with a vertical member and one or both cross members.

In accordance with still another aspect of the disclosure, there is provided a backpack and an umbrella, in combination, the backpack having a large main compartment, at least one shoulder strap, a hip belt, and one or more side pockets. The main compartment has a main compartment fastener such that the main compartment may be opened or secured closed, the main compartment containing a main pocket. The backpack also has an umbrella compartment, the umbrella being sized and configured to removably fit substantially within the umbrella compartment when the umbrella is in a closed position. The umbrella compartment contains a socket including a clamp at a bottom thereof, the clamp being configured to secure the handle of the umbrella, and the umbrella compartment and socket being configured to hold the umbrella in an axial position relative to the longitudinal axis of the backpack when the handle is secured by the clamp, wherein the umbrella compartment includes a flap. The flap is configured to cover the top of the umbrella compartment, and includes a flap fastener such that the flap may be opened or secured shut.

Additional features and advantages are provided forth in the description which follows, and will become apparent from the description, or may be learned by practice of the backpack arrangement disclosed. The foregoing general description and the following detailed description are exemplary and explanatory and are intended to provide further explanation of thereof.

BRIEF DESCRIPTION OF THE DRAWINGS

The accompanying drawings are included to provide a further understanding of the backpack arrangement and are incorporated into and constitute a part of this disclosure. They illustrate one embodiment of the arrangement and, together with the description, serve to explain the principles thereof.

The same numerals are used throughout the figure drawings to designate similar elements. Still other objects and advantages of the disclosure will become apparent from the following description of the preferred embodiments.

DETAILED DESCRIPTION

Figure 1:
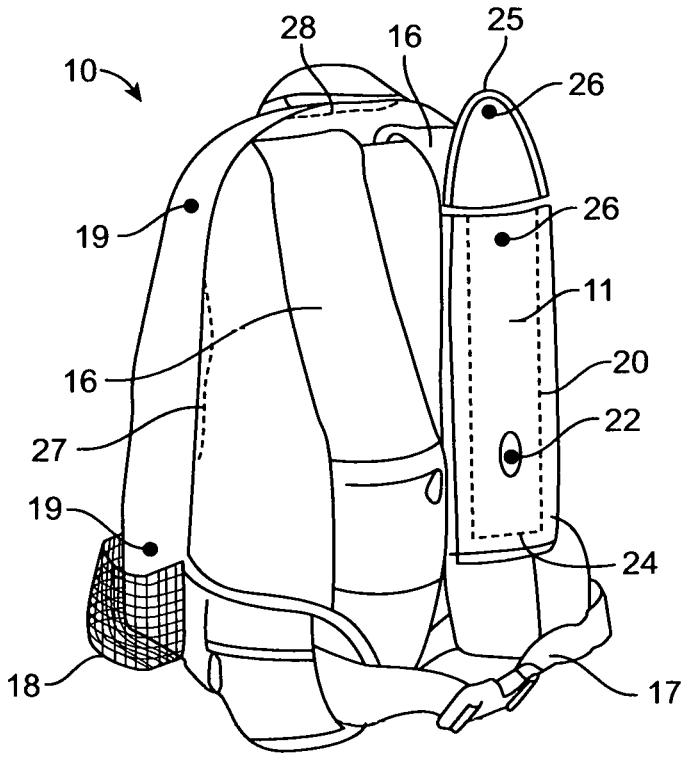
FIG. 1 is a rear perspective view of an exemplary embodiment of a backpack arrangement, showing a backpack, an umbrella compartment, a flap, shoulder straps, a hip belt, earphone apertures, and a side pocket.
Figure 2:
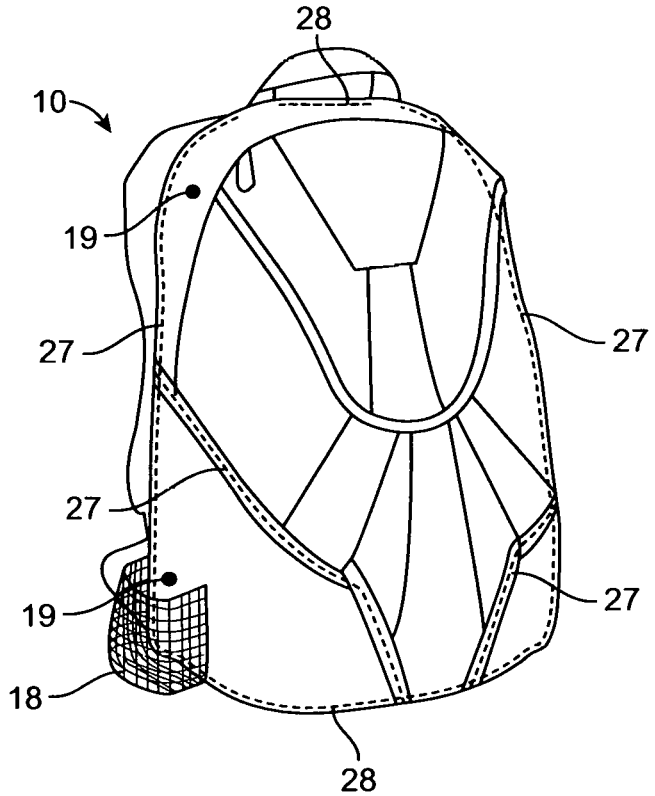
FIG. 2 is a front perspective view of the embodiment illustrated in FIG. 1, showing a backpack, a zipper, shoulder straps, a hip belt, earphone apertures, and a side pocket.
Figure 3:
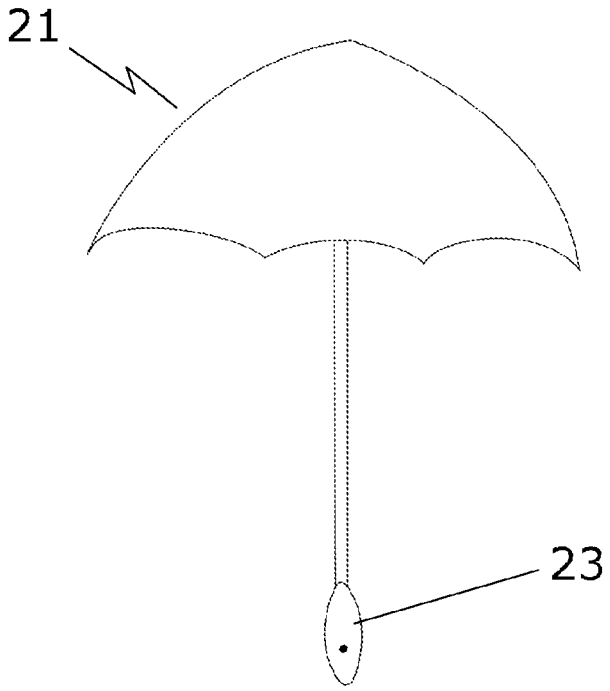
FIG. 3 is a side view of the umbrella component of the embodiment set forth in FIG. 1, showing an umbrella, and an umbrella handle.
Figure 4:
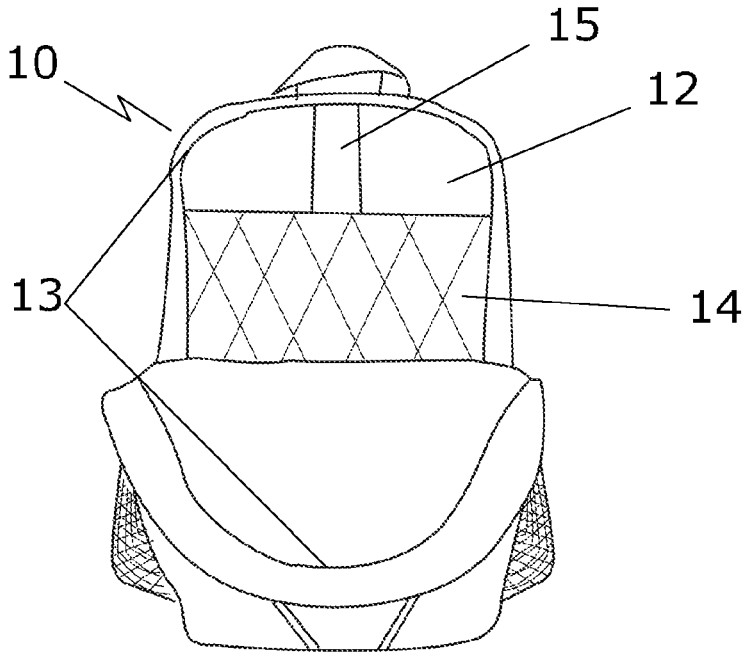
FIG. 4 is a front view of the embodiment provided in FIG. 1, with the zipper opened, displaying the backpack, the zipper, and main pocket.

Referring now to the drawings and, more particularly, to FIGS. 1-4, there is shown generally a specific, illustrative backpack with electronic device storage and an umbrella compartment, according to various aspects of the disclosure. According to a first exemplary embodiment, a backpack 10 is provided which is preferably fully waterproofed and has a large main compartment 12 secured with a zipper 13. The main compartment provides a large, padded main pocket 14 with a hook-and-loop strap 15, wherein a mobile electronic device may be securely stored with a snug fit. Backpack 10 provides shoulder straps 16 and a hip belt 17 which support most of the weight of the loaded backpack, and one or more side pockets 18 which are preferably manufactured from a flexible, durable mesh material. Shoulder straps 16 and hip belt 17 are preferably adjustable in length.

Desirably, one or more earphone apertures 19 are provided, which enable(s) audio files to be accessed and played from a mobile electronic device stored in main pocket 14 while the backpack is being worn. The backpack further provides a long, slender, cylindrical umbrella compartment 11, with a deep socket 20 within the umbrella compartment which supports a user's umbrella 21 when the umbrella is opened. Umbrella compartment 11 is covered by a flap 25 that is secured shut by fastener 26. The fastener can be a hook-and-loop strip, snaps, buttons, or any other appropriate fastener known to those skilled in the art. Socket 20 provides a clamp 22 which may be secured to a handle 23 of umbrella 21, which, in turn, fits securely in the bottom 24 of the socket.

Backpack 10 further provides a rigid frame with two vertical members 27 at the sides and two cross members 28 at the top and bottom, respectively. The cross members are curved, and the vertical members are shaped in a shallow S-curve, to comfortably accommodate the shape of a user's back. The frame is internal to the backpack, and padded for comfort. Umbrella 21 is stored in a rigid cylindrical compartment 11, which is braced against the frame with diagonal members, such that each diagonal member forms triangles with a vertical member and one or both cross members, providing maximum structural strength.

To use the first exemplary embodiment, the user may store a laptop, tablet, or other mobile electronic device in main pocket 14, securing it with hook-and-loop strap or fastener 15, and may plug earphones into the device using one of earphone apertures 19. The user then puts on shoulder straps 16 in a conventional manner, adjusting the length of the shoulder straps such that they fit loosely about the user's shoulders. The user then fastens hip belt 17 and adjusts the length of the hip belt so that it fits snugly on the user's pelvis, supporting most of the weight of the backpack.

If inclement weather is approaching, the user may elect to remove the backpack, open flap 25, remove the umbrella 21 from umbrella compartment 11, insert handle 23 of the umbrella into socket 20, put on the backpack, and open the umbrella. After the inclement weather has ended, the umbrella may be closed and placed in the umbrella compartment. The umbrella is suitably sized and configured to removably fit substantially within the umbrella compartment when the umbrella is in the closed position.

Backpack 10, main pocket 12, flap 25, shoulder straps 16, and hip belt 17 are preferably made of a flexible, durable material that is substantially waterproof, such as nylon fabric. Zipper 13, umbrella compartment 11, socket 20, vertical members 27, cross members 28, and the diagonal members are preferably constructed of rigid, durable materials that are corrosion resistant and lightweight and provide substantial structural strength, such as stainless steel, brass, wood, and aluminum alloy.

Although the components, component sizes, and materials listed above are considered preferable, artisans will recognize that alternate components and materials could be selected without altering the scope of this disclosure. Overall, the backpack arrangement disclosed advantageously allows the user to provide an umbrella of the user's choice. A rigid frame is provided with two vertical members at the sides and two cross members at the top and bottom, the frame being internal to the backpack, and padded for comfort. The umbrella is readily stored in the umbrella compartment, e.g., the rigid cylindrical compartment, which is braced against the frame with diagonal members, such that each diagonal member forms triangles, with a vertical member and one or both cross members providing maximum structural strength. Moreover, and beneficially, both a retractable umbrella canopy is provided that is fully supported by an umbrella compartment of the backpack while the backpack is worn, whether the umbrella is opened or closed, and secure, waterproof storage for a mobile electronic device within the backpack. Such storage desirably also provides an aperture for enabling earphones worn by the user to be connected to the stored mobile electronic device.

While the foregoing written description enables one of ordinary skill in the art to make and use what is presently considered to be the best mode thereof, those of ordinary skill will understand and appreciate the existence of variations, combinations, and equivalents of the specific embodiments, methods, and examples herein. The invention is, therefore, not limited by the above-described embodiments, methods, and examples, but by all embodiments and methods within the scope and spirit thereof.

I claim:

1. A backpack and an umbrella, in combination: said backpack having a large main compartment, at least one shoulder strap, a hip belt, and one or more side pockets; said main compartment having a main compartment fastener such that the main compartment may be opened or secured closed; said main compartment containing a main pocket; an umbrella compartment; said umbrella being sized and configured to removably fit substantially within said umbrella compartment when the umbrella is in a closed position; said umbrella compartment containing a socket; said socket including a clamp at a bottom of the socket; said clamp being configured to secure the handle of said umbrella; said umbrella compartment and socket being configured to hold said umbrella in an axial position relative to the longitudinal axis of the backpack when said handle is secured by said clamp, wherein said umbrella compartment is affixed to one of said shoulder straps, and includes a flap; said flap being configured to cover the top of said umbrella compartment; said flap including a flap fastener such that the flap may be opened or secured shut.

2. The backpack and umbrella, in combination, as set forth in claim 1, wherein said main pocket being padded; said main pocket being sized and configured to hold a mobile electronic device within; and said main pocket including a main pocket fastener such that the main pocket may be opened or secured closed.

3. The backpack and umbrella, in combination, as set forth in claim 2, wherein said main pocket fastener is a hook and loop strip.

4. The backpack and umbrella, in combination, as set forth in claim 1, wherein the shoulder straps and the hip belt are adjustable in length.

5. The backpack and umbrella, in combination, as set forth in claim 1, wherein said backpack further includes one or more earphone apertures; said earphone apertures providing access to said main compartment such that earphones may be connected to a mobile electronic device.

6. The backpack and umbrella, in combination, as set forth in claim 1, further comprising a rigid frame; said rigid frame having two vertical members at each side of the backpack and two cross members at a top and bottom of the backpack.

7. The backpack and umbrella, in combination, as set forth in claim 6, wherein said cross members are curved, and vertical members are shaped in a shallow S-curve.

8. The backpack and umbrella, in combination, as set forth in claim 7 wherein said rigid frame is internal to the backpack, and padded.

9. The backpack and umbrella, in combination, as set forth in claim 6, wherein said rigid frame is internal to the backpack, and padded.

10. The backpack and umbrella, in combination, as set forth in claim claim 1, wherein said backpack is waterproofed.

11. The backpack and umbrella, in combination, as set forth in claim claim 1, wherein said flap fastener may be any one of a hook-and-loop strip, snap, or button.

12. A backpack and an umbrella, in combination: said backpack having a large main compartment, at least one shoulder strap, a hip belt, and one or more side pockets; said main compartment having a main compartment fastener such that the main compartment may be opened or secured closed; said main compartment containing a main pocket; an umbrella compartment; said umbrella being sized and configured to removably fit substantially within said umbrella compartment when the umbrella is in a closed position; said umbrella compartment containing a socket; said socket including a clamp at a bottom of the socket; said clamp being configured to secure the handle of said umbrella; said umbrella compartment and socket being configured to hold said umbrella in an axial position relative to the longitudinal axis of the backpack when said handle is secured by said clamp, the backpack further comprising a rigid frame; said rigid frame having two vertical members at each side of the backpack and two cross members at a top and bottom of the backpack, wherein said umbrella compartment is braced against the frame with diagonal members, such that each diagonal member forms triangles with a vertical member and one or both cross members.

13. A backpack and an umbrella, in combination, said backpack having a large main compartment, at least one shoulder strap, a hip belt, and one or more side pockets; said main compartment having a main compartment fastener such that the main compartment may be opened or secured closed; said main compartment containing a main pocket; an umbrella compartment; said umbrella being sized and configured to removably fit substantially within said umbrella compartment when the umbrella is in a closed position; said umbrella compartment containing a socket; said socket including a clamp at a bottom of the socket; said clamp being configured to secure the handle of said umbrella; said umbrella compartment and socket being configured to hold said umbrella in an axial position relative to the longitudinal axis of the backpack when said handle is secured by said clamp, wherein said umbrella compartment includes a flap; said flap being configured to cover the top of said umbrella compartment; said flap including a flap fastener such that the flap may be opened or secured shut.

14. The backpack and umbrella, in combination, as set forth in claim claim 13, wherein said flap fastener may be any one of a hook-and-loop strip, snap, or button.

* * * * *